United States Patent [19]

Masuda et al.

[11] Patent Number: 5,038,469

[45] Date of Patent: Aug. 13, 1991

[54] METHOD OF MAKING A POROUS ROLL ASSEMBLY

[75] Inventors: Masao Masuda, Nagoya; Masanobu Masuda, Okazaki; Toyohiko Hikota, Toyohashi, all of Japan

[73] Assignee: Masuda Seisakusho Co., Ltd., Aichi, Japan

[21] Appl. No.: 570,546

[22] Filed: Aug. 21, 1990

[30] Foreign Application Priority Data

Aug. 22, 1989 [JP] Japan ..... 1-215327
Nov. 24, 1989 [JP] Japan ..... 1-305160

[51] Int. Cl.[5] ..... B21B 13/02

[52] U.S. Cl. ..... 29/895.213; 29/125; 29/895.21

[58] Field of Search ..... 29/895.21, 895.213, 29/895.3, 125, 895.32, 123, 124, 130; 156/305, 290

[56] References Cited

U.S. PATENT DOCUMENTS

| | | | |
|---|---|---|---|
| 2,637,892 | 5/1953 | Rockoff | 28/28 |
| 2,813,051 | 11/1957 | MacHenry | 156/305 X |
| 3,364,546 | 1/1968 | Martin | 29/125 X |
| 3,599,306 | 8/1971 | Brafford | 29/132 |
| 3,613,145 | 10/1971 | Kneusels | 29/130 X |
| 3,710,469 | 1/1973 | Kitazawa | 29/125 |
| 3,814,054 | 6/1974 | Tajihi | 29/895.213 X |
| 3,932,687 | 1/1976 | Okamoto | 428/288 |
| 4,283,821 | 8/1981 | Paakkunainen | 29/130 X |
| 4,475,215 | 10/1984 | Edwards | 29/895.213 X |
| 4,535,611 | 8/1985 | Masuda | 68/202 |
| 4,604,778 | 8/1986 | Edwards | 29/124 X |

FOREIGN PATENT DOCUMENTS

| | | |
|---|---|---|
| 0059837 | 9/1983 | European Pat. Off. . |
| 2931171 | 3/1980 | Fed. Rep. of Germany . |
| 59-110916 | 6/1984 | Japan . |
| 61-262586 | 11/1986 | Japan . |
| 1-36951 | 11/1989 | Japan . |

*Primary Examiner*—Timothy V. Eley
*Assistant Examiner*—C. Richard Martin
*Attorney, Agent, or Firm*—William H. Eilberg

[57] ABSTRACT

The present invention provides a porous roll assembly which comprises a core shaft and a porous roll body fitted on the shaft. The roll body include a stack of axially compressed porous disks. According to the method of the invention, the stack of porous disk is compressed divisionally and successively, so that all of the disks are evenly compressed even if the roll body is relatively long. The resulting roll body is substantially uniform in Shore hardness and porosity over the entire length of the roll body.

9 Claims, 4 Drawing Sheets

METHOD OF MAKING A POROUS ROLL ASSEMBLY

BACKGROUND OF THE INVENTION

1. Field of the Invention

This invention relates generally to porous rolls. More particularly, the invention relates to a porous roll assembly which comprises a stack of porous disks fitted on a core shaft as axially compressed. The present invention also relates to a method of making such a porous roll assembly.

2. Description of the Prior Art

Porous rolls are used for example for removing liquids from object surfaces such as the surfaces of films, steel plates, metallic foils or printed circuit boards. In use, the porous roll is held in rolling contact with the object surface, and the unwanted liquid is absorbed by the capillary action provided by minute pores of the roll. Further, when the roll is forcibly pressed against the object surface, the void volume of the roll is temporarily reduced at a portion thereof compressively contacting the object surface, so that a negative pressure is developed within that roll portion upon elastic restoration thereof following the contact. Obviously, the thus generated negative pressure greatly helps the absorptive action of the roll.

A typical porous roll comprises a core shaft and a porous roll body fitted on the core shaft. The roll body may be made of various materials such for example as non-woven fabric, porous synthetic rubber reinforced by fibers (or non-woven fabric impregnated with synthetic rubber or binder), or porous synthetic rubber alone. The core shaft may be solid or hollow.

When the core shaft is hollow, the shaft may be made to have a cylindrical wall which is formed with a plurality of radial through-holes, and one axial end (open end) of the shaft is connected to a suction device. According to this arrangement, a suction force applied to the core shaft is utilized to assist the absorptive action of the roll body, and to discharge the absorbed liquid out of the roll. Thus, the roll can be used for continuous liquid removal without requiring occasional interruption. Further, if the open end of the core shaft is connected to a liquid supply device, the roll may be also used to continuously supply a suitable liquid for intended surface treatment.

Porous rolls may be manufactured by several methods. One of such methods is described for example in Japanese patent application Laid-open No. 61-262586 (Laid-open: November 20, 1986; application Ser. No.: 60-104022; Filed: May 17, 1985; Applicant: Masuda Seisakusho Co., Ltd. and Toray Industries, Inc.; Inventors: Toyohiko HIKOTA and Masao MASUDA).

According to the method disclosed in the above laid-open application, a predetermined number of axially stacked porous disks are fitted on a core shaft, and simultaneously subjected to an axial compressive force in a single step. As a result, the pore size of the compressed porous disks is rendered far smaller than that of the uncompressed porous disks, thereby increasing the capillary ability of the roll.

The prior art method described above is acceptable as long as the length of the roll is relatively small. However, if the roll length is large, there arises a problem that the porous disks are not evenly compressed. More specifically, when axially compressing the stack of porous disks on the core shaft, the axial compressive force must be transmitted throughout the disk stack against the friction of the disks relative to the core shaft, and such a friction cumulatively increases as the axial position of the disk becomes farther from the compression (force) applying position. Therefore, those disks located farther from the compression applying position are compressed to a smaller degree than those located closer to the compression applying position.

Obviously, uneven compression of the porous disks results in that the porosity of the roll body varies along the length of the roll, consequently causing uneven liquid absorption or supply. Further, the hardness of the roll body also varies along the length of the roll, so that the roll body comes into uneven rolling contact with the object surface to result also in non-uniform liquid absorption or supply. Such uneven liquid absorption or supply leads to inappropriate surface treatment, or necessitates repetition of the same surface treatment before achieving an acceptable result.

SUMMARY OF THE INVENTION

It is, therefore, an object of the present invention to provide a method of making a porous roll assembly by means of which an overall stack of porous disks is evenly compressed to provide a substantially uniform hardness and porosity over the entire length of the disk stack even if the stack length is rendered large.

Another object of the present invention is to provide a method of making a porous roll assembly by means of which individual porous disks constituting a porous roll body are integrated at least in an outer surface portion of the roll body.

A further object of the present invention is to provide a porous roll assembly which comprises an overall stack of evenly compressed porous disks to have a substantially uniform hardness and porosity over the entire length of the disk stack even if the stack length is large.

Still another object of the present invention is to provide a porous roll assembly wherein individual porous disks constituting a porous roll body are integrated at least in an outer surface portion of the roll body.

According to one aspect of the present invention, there is provided a method of making a porous roll assembly which comprises a core shaft and a porous roll body fitted on the core shaft, the roll body comprising an overall stack of porous disks which are axially compressed, each disk having a central opening for fitting on the core shaft, the method comprising the steps of: (a) fixing a stopper to one end portion of the core shaft; (b) conducting a first compression step which includes fitting a first sub-stack of porous disks on the core shaft into abutment with the stopper, applying an axial compressive force to the first disk sub-stack, and relieving the compressive force; (c) similarly conducting subsequent compression steps each of which includes fitting a relevant sub-stack of porous disks on the core shaft into abutment with the first or a preceding disk sub-stack, applying an axial compressive force to the relevant sub-stack, and relieving the compressive force; and (d) conducting a last compression step which includes fitting a last sub-stack of porous disks on the core shaft into abutment with a preceding disk sub-stack, applying an axial compressive force to the last sub-stack, and fixing another stopper to the other end portion of the core shaft while the axial compressive force is still applied.

According to the method described above, the overall stack of porous disks is divided into a plurality of sub-stacks or groups, and the axial compression of the porous disks are performed successively group by group. Therefore, the compressive force can be effectively transmitted to all of the disks during the successive steps of compressing.

Conventionally, the friction between the core shaft and the porous disks hinders the compressive force to be transmitted to those disks which are located away from the force applying point. According to the method of the present invention, on the other hand, the friction between the core shaft and the porous disks is positively utilized so that earlier compressed sub-stacks of porous disks will be prevented from elastically restoring to the natural state and thereby remain compressed exactly or nearly to the full extent even after relieving the compressive force during the successive compression.

For a known lot of porous disks (therefore the characteristics of the disks being already known), the successive compression may be started without any preliminary step for determining the number of porous disks to be included in each sub-stack and the axial compressive force to be applied to the disk sub-stack. For an unknown lot of porous disks, on the other hand, such a preliminary step should be preferably performed prior to conducting the first compression step.

When each porous disk is made of fibers and a binder, the method may further comprise the steps of: (e) preparing a solvent which selectively dissolves the binder; (f) causing the solvent to diffuse into the porous roll body to dissolve the binder; and (g) removing the solvent from the porous body to allow the dissolved binder to re-coagulate in the porous body.

When the binder of the porous disk is polyurethane for example, candidates for the solvent include dimethylformamide (DMF) and dimethyl sulfoxide (DMSO). DMF or DMSO, which has dissolved the polyurethane binder, may be easily removed by water for causing re-coagulation of the binder, so that the roll body can be integrated by such re-coagulation. Further, removal of DMF or DMSO forms minute pores within the roll body.

Preferably, the solvent may additionally contain a substance which is identical to the binder of the porous disk. Alternatively, the solvent additionally contains a binder substance which has affinity with the binder of the porous disk. Further advantageously, the solvent may additionally contain a cell stabilizer.

The present invention further provides a porous roll assembly which is obtained by the above-described method, wherein the porous roll body is rendered substantially uniform in Shore hardness and porosity over the entire length of the roll body. When the roll assembly is subjected to the treatment by the solvent, the porous disks can be fused to each other at least in an outer surface portion of the roll body.

Other objects, features and advantages of the present invention will be fully understood from the following detailed description given with reference to the accompanying drawings.

BRIEF DESCRIPTION OF THE ACCOMPANYING DRAWINGS

DETAILED DESCRIPTION

Figure 11:
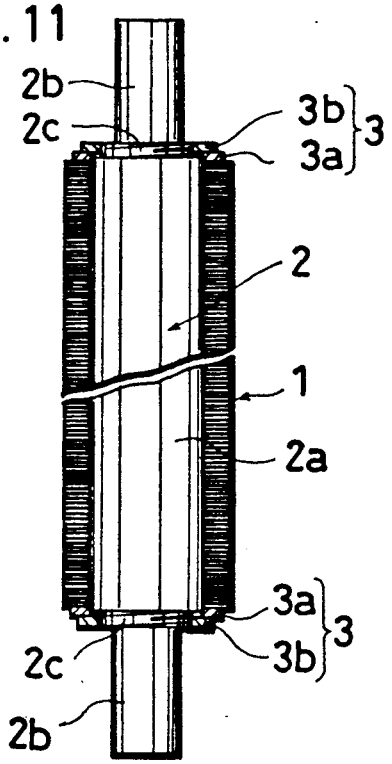
FIG. 11 is a front view showing the porous roll assembly obtained by the method shown in FIGS. 1 through 10.

Referring first to FIG. 11 of the accompanying drawings, a porous roll assembly according to the present invention mainly includes a porous roll body 1, and a core shaft 2 inserted into the roll body. The core shaft has a diametrically larger central roll mounting portion 2*a*, and a pair of diametrically smaller end portions 2*b* which are coaxial with the shaft central portion to be used for rotatably supporting the roll assembly during use. Intermediate the shaft central portion and each end portion is a threaded portion 2*c*.

The porous roll body 1 is held compressed on the central portion 2*a* of the core shaft 2 between a pair of stoppers 3. Each stopper comprises an abutment ring 3*a* for axially coming into stopping abutment with the roll body, and a nut 3*b* engaging with a corresponding threaded portion 2*c* of the shaft.

Figure 12:
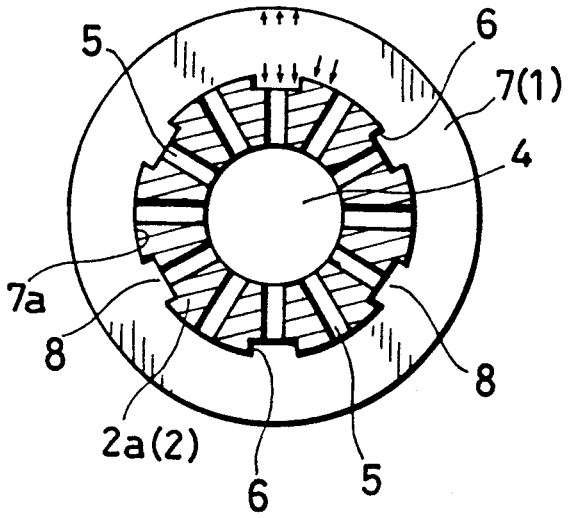
FIG. 12 is a view showing the roll assembly in traverse section.
Figure 13:
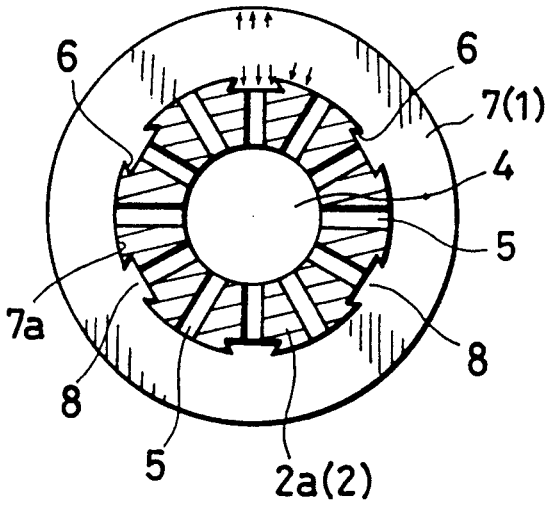
FIG. 13 is a sectional view similar to FIG. 12 but showing another porous roll assembly incorporating a differently configured core shaft.

The core shaft 2 preferably has an axial bore 4, as shown in FIGS. 12 and 13. The bore may be open at one axial end, but closed at the other axial end. The open end of the bore may be used for connection to a suction device (not shown) when the roll assembly is used for liquid absorption. Alternatively, the open end of the bore may be connected to a liquid supply device (not shown) when the roll assembly is used for liquid supply.

As also shown in FIGS. 12 and 13, the central roll mounting portion 2*a* of the core shaft 2 has a cylindrical wall which is formed with a multiplicity of radial through-holes 5 communicating with the axial bore 4 of the shaft. Thus, when suction is applied to the axial bore, unwanted liquid absorbed by the porous roll body 1 is forcibly sucked into the axial bore for discharge. On the other hand, when a suitable treatment liquid is supplied to the axial bore 4, such a liquid is forced out through the roll body for intended surface treatment.

Advantageously, the cylindrical wall of the shaft central portion 2*a* is externally formed with axially extending grooves 6 at equal angular spacing. For the reason to be described later, it is preferable that the width of each groove at the bottom is not smaller than the width at the groove opening. Thus, the cross-sectional shape of the groove may be rectangular, as shown in FIG. 12. Alternatively, the cross-sectional shape of the groove may be trapezoidal, as shown in FIG. 13.

The porous roll body 1 consists of axially stacked disks 7 each of which is porous and axially compressible. Each disk has a central opening 7*a* which is formed with radially inward projections 8 in complementary relation to the axial grooves 6 of the core shaft 2, as shown in FIGS. 12 and 13. Preferably, in natural state, the central opening of the porous disk is slightly smaller in diameter than the central mounting portion 2*a* of the shaft. Thus, when assembled, the disk is diametrically expanded for fitting on the shaft central portion.

The porous disks 7 may be prepared by punching out from porous sheets. Such a porous sheet may be made of non-woven fabric, porous synthetic rubber reinforced by fibers (or non-woven fabric impregnated with porous synthetic rubber or binder), or porous synthetic rubber alone.

According to the present invention, all of the porous disks 7 providing the roll body 1 are compressed substantially to the same degree. Thus, the roll body is made to have a uniform porosity and Shore hardness over the entire length thereof.

Now, a specific method for axially compressing the disk stack is fully described according to the following example.

EXAMPLE 1

A core shaft 2 used in this example is made of stainless steel, and has a central roll mounting portion 2*a* which is 150 mm in outer diameter and 1,600 mm in effective length. The shaft central portion is externally formed with six (6) of axially extending grooves 6 each of which is rectangular in cross section with a width of 12 mm and a depth of 5 mm (see FIG. 12).

Each of porous disks 7 used in this example is made of porous polyurethane rubber reinforced by bundles of 0.14 denier polyester fibers, each bundle consisting of sixteen (16) fibers. Such fiber-reinforced rubber is specifically described in U.S. Pat. No. 3,932,687 and available for example from TORAY INDUSTRIES, INC., Japan (GS Felt Product No. K10220M). In natural state, the disk is 250 mm in outer diameter, 0.22 cm in thickness, and 0.25 in apparent density. The inner diameter of the disk is 145.5 mm, which means that the disk inner diameter is 3% smaller than the outer diameter (150 mm) of the shaft central portion 2*a*.

Using the core shaft and porous disks described above, the axially compressed roll body is successively prepared in the following manner.

Figure 1:
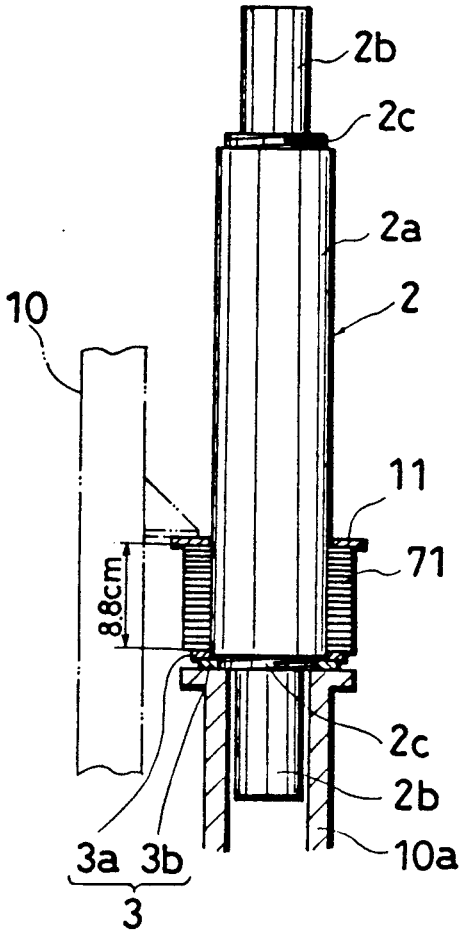
FIGS. 1 through 10 are view showing successive stages of making a porous roll assembly according to the present invention.

First, a stopper 3 consisting of an abutment ring 3*a* and a nut 3*b* is screwably fixed to one threaded portion 2*c* of the core shaft 2, and the shaft is vertically supported on a support base 1O*a* of a press machine 10 with the mounted stopper directed downward, as shown in FIG. 1. Then, a first sub-stack or group 71 of forty (40) porous disks is fitted over the shaft into abutment with the mounted stopper, and a presser ring 11 is placed on the first disk sub-stack from above. Before compressing (namely in natural state), the first disk sub-stack has a length of 8.8 cm.

Figure 2:
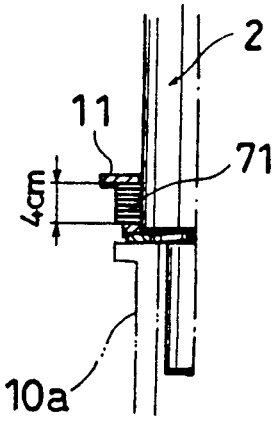
Figure 3:
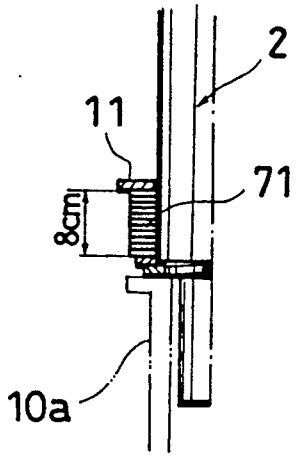

Subsequently, the press machine 10 is actuated for axially compressing the first disk sub-stack 71 with a pressure of 20 kg/cm$^2$, thereby compressing the first disk sub-stack to a length of 4.O cm, as shown in FIG. 2. Because of the axial compression, material flows occur in each porous disk 7 so that the inner diameter of the disk tends to reduce while the outer diameter thereof is increased, as shown by arrows in FIG. 12. As a result, more material is forced into the axial grooves 6 of the core shaft 2, consequently increasing the friction between the first disk sub-stack and the core shaft. Combined with the initial setting of the inner diameter of each disk which is smaller than the outer diameter of the shaft central portion to provide a relatively larger initial friction, the frictional increase provided by the material flows serves to restrain elastic restoration of the first disk sub-stack. Thus, upon removal of the axial compressive force, the first disk sub-stack is elastically restored only to a length of 8 cm which is smaller than the initial natural length (8.8 cm), as shown in FIG. 3.

Figure 4:
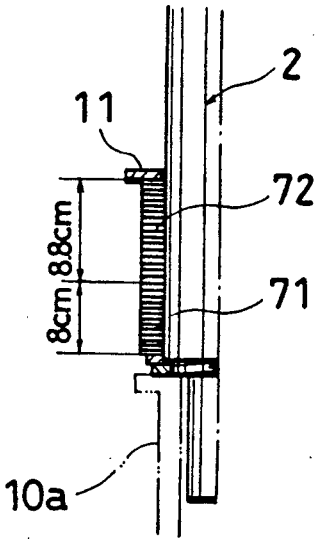
Figure 5:
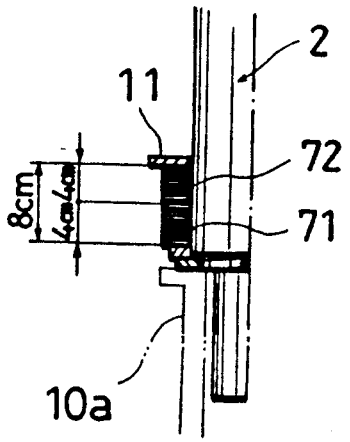
Figure 6:
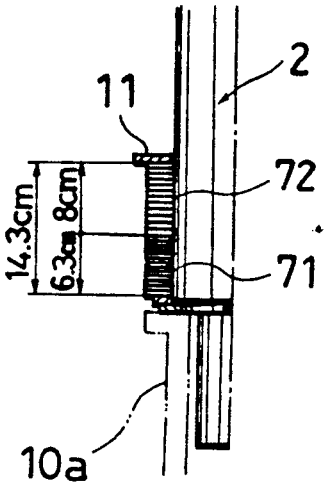

Next, a second sub-stack 72 of forty 940 ) porous disks is fitted on the central portion 2*a* of the core shaft 2 immediately above the partially compressed first disk sub-stack 71 to give a combined length of 16.8 cm, as shown in FIG. 4. The press machine was again actuated for axially compressing the first and second disk sub-stacks with a pressure of 20 kg/cm$^2$, thereby compressing the two disk sub-stacks to a combined compressed length of 8 cm, as shown in FIG. 5. Upon compression removal, the second disk sub-stack 72 is elastically restored to a length of 8 cm, whereas the length of the first disk sub-stack 71 is restored only to a further limited length of 6.3 cm, as shown in FIG. 6. The further limitation in elastic restoration of the first disk sub-stack is attributed to the friction between the second disk sub-stack 72 and the shaft central portion 2*a*.

Figure 7:
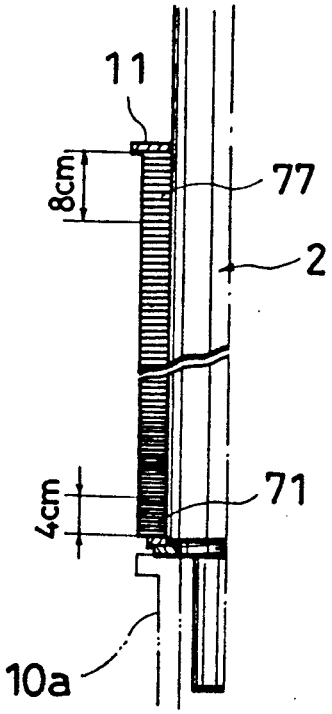
Figure 8:
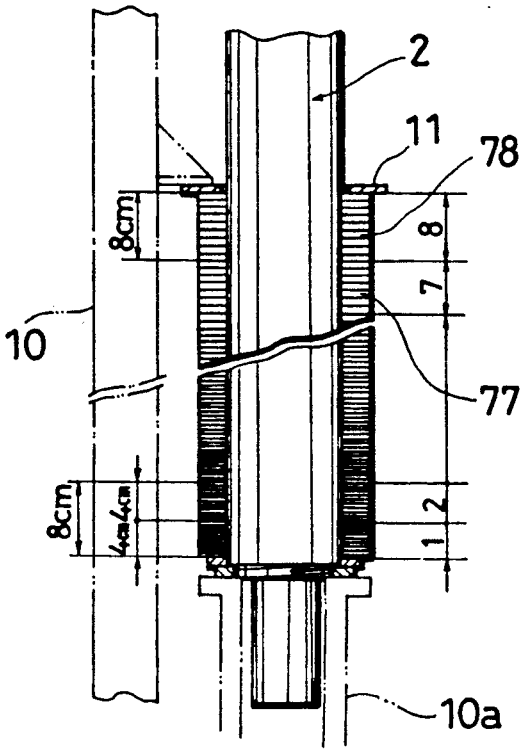

A similar compressing operation is repeated with respect to a third and subsequent disk sub-stacks. When completing axial compression with respect to the seventh disk sub-stack 77, the first disk sub-stack 71 remains fully compressed to a length of 4 cm even upon compression removal, as shown in FIG. 7. The same phenomenon also occurs with respect to the second disk sub-stack 72 when finishing axial compression for the eighth disk sub-stack 78, as shown in FIG. 8.

Figure 9:
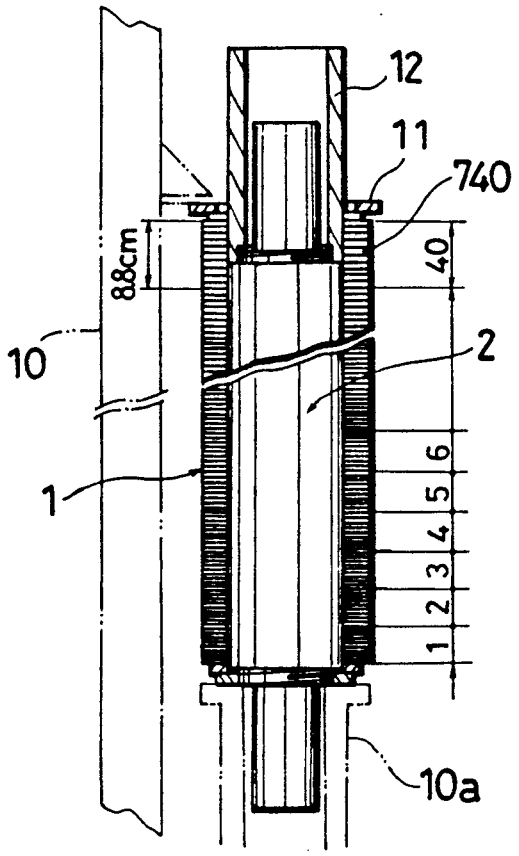
Figure 10:
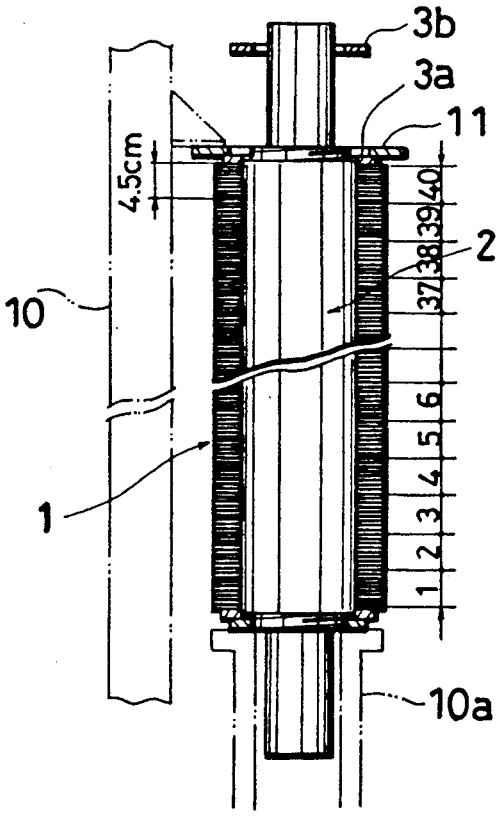

The repetition of such successive compressing operation is performed up to the fortieth disk sub-stack 740. Obviously, prior to performing axial compression of the last disk sub-stack, the combined length (not fully compressed) of all the disk sub-stacks is larger than the effective length (1,600 mm) of the shaft central portion 2*a*. Therefore, a cylindrical guide tube 12 having an outer diameter equal to that of the shaft central portion need be attached to the upper end of the core shaft before fitting the last disk sub-stack, as shown in FIG. 9. After completing the axial compression of the last disk sub-stack 740, a nut 3*b* is engaged with the upper threaded portion 2*c* of the core shaft 2 prior to removal of the compressive force, as shown in FIG. 10.

As a result of the above successive compression, a porous roll assembly is obtained, as shown in FIG. 11. The roll body 1 of the obtained roll assembly is 1,600 mm in length. The Shore hardness of the roll body is Hs60, whereas the apparent density is 0.5. Further, the Shore hardness and porosity of the roll body is substantially uniform throughout the entire length thereof.

To confirm the performance of the porous roll assembly thus obtained, two such roll assemblies are used to constitute a dehydrator for wet steel plates (e.g. steel plates obtained after water-cooling in an iron works). The core shaft of each roll assembly is connected at its open axial end with a suction device (not shown) for evacuation. As a result of this performance test, it has been found that the roll assembly according to the invention is capable of uniformly and completely removing water form the steel plate surface over the entire width thereof. In fact, the roll assembly of the present invention is about 20–50 times as effective for dehydration as conventional rolls.

In Example 1 described above, the number of porous disks to be incorporated in each sub-stack is forty (40), and the compressive force applied for successive compression is 20 kg/cm$^2$. However, the number of disks for the individual sub-stack and the applicable compressive force may be optionally selected depending on various parameters such as individual disk thickness, disk material (elasticity), initial disk porosity, initial disk harness, disk friction relative to the core shaft, desired final roll porosity, desired final roll hardness, dimensions of the shaft grooves, and etc.

Preferably, therefore, a preliminary step of determining the disk number (for each sub-stack) and the applicable compressive force should be performed for a given lot of porous disks before actually conducting successive compression for fabricating the porous roll assembly. In such a preliminary step, a certain number of porous disks are axially stacked and compressed with a measurable pressure to measure the Shore hardness and porosity of the compressed disk stack.

Because of the unique successive compression according to the present invention, the porous roll body 1 of the assembly obtained in Example 1 above is substantially uniform in Shore hardness and porosity (apparent density) over the entire length thereof, as already described. When viewed macroscopically, the porosity of the roll body is truly uniform. However, the roll body actually consists of separate thin disks as axially compressed, and there is no material fusion between the individual disks. When viewed microscopically, therefore, the porosity of the roll body is discontinuously different at the interfaces between the individual disks.

Further, the individual disks are punched out from a fiber-reinforced porous rubber sheet material. Thus, the reinforcing fibers are cut along the outer circumference of the individual disk, and may partly remain as short fibers at the peripheral edge of the disk. Obviously, the short fibers are easy to come off the roll body during use, thereby contaminating the surface to be treated. Such fiber contamination becomes particularly problematic when the roll assembly is used for article such as printed circuit boards requiring minimum contamination.

Another aspect of the present invention provides a method for imparting integrity to a disk stacked roll body to eliminate the problems described above. Such a method is now described on the basis of the following two examples.

EXAMPLE 2

Figure 14:
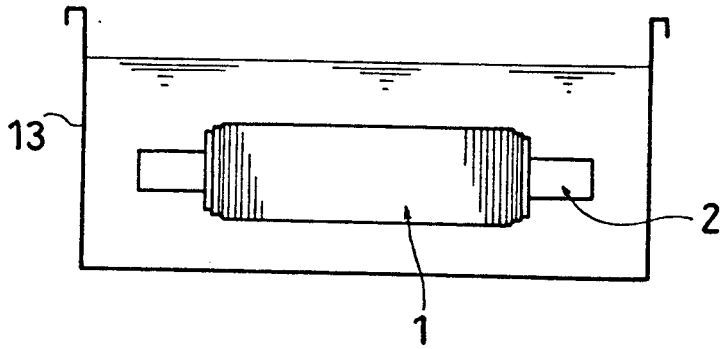
FIG. 14 is a schematic view showing a solvent bath for use in making an improved roll assembly.
Figure 16:
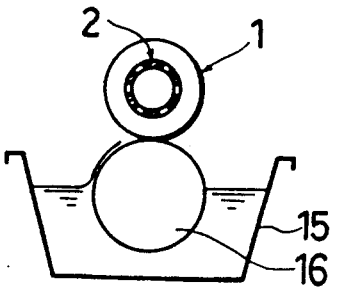
FIG. 16 is a schematic view showing another solvent bath for use in making a similar improved roll assembly.

The porous roll assembly prepared in Example 1 is immersed in a bath 13 containing dimethylformamide (DMF) for five (5) minutes, as shown in FIG. 14. As a result, DMF diffuses into the porous roll body 1, and partially dissolves the polyurethane binder (but not the reinforcing fibers). The resulting solution of DMF and polyurethane is held within the roll body.

Subsequently, the roll assembly thus treated is immersed in a water bath 14. As a result, DMF retained within the roll body 1 diffuses into the water, whereas the polyurethane previously dissolved in DMF is allowed to coagulate in situ. Due to DMF removal into the water, continuous pores are formed in the coagulated polyurethane binder.

According to the above treatment, the polyurethane binder at least in an outer peripheral portion of the roll body 1 is first dissolved and then re-coagulated portion of the roll body 1 is first dissolved and then re-coagulated into an integral porous body. As a result, the distinct interfaces previously observed between the individual disks are no longer present, and the reinforcing fibers at the roll outer surface are fixedly retained by the re-coagulated binder.

Preferably, the DMF bath 13 may further contain polyurethane dissolved in DMF, or a different binder material having affinity with polyurethane (disk binder). Examples of different binder material include acrylonitrile butadiene rubber and polychloroprene rubber.

Further advantageously, the DMF bath 13 may additionally contain a cell stabilizer. Examples of cell stabilizer include silicone derivatives, and esters of high molecular fatty acids.

DMF used in this example may be replaced by a different solvent such as dimethyl sulfoxide (DMSO) which dissolves polyurethane (or other disk binders), and can be easily removed by water for wet coagulation of the once dissolved binder.

When immersing the roll assembly in the DMF bath 13 (additionally containing polyurethane or a different binder compatible with polyurethane), the open axial end of the core shaft 2 may be connected to a suction device (not shown) so that DMF is forcibly caused to diffuse into the roll body 1. Such a measure ensures that DMF reaches to the full depth of the roll body. Further, instead of immersing the roll assembly in the DMF bath 13, the axial open end of the core shaft 2 may be connected to a DMF supply device.

Similarly, when immersing the roll assembly in the water bath 14, the open axial end of the core shaft 2 may be connected to a suction device (not shown) so that DMF retained in the porous roll body 1 can be rapidly removed for accelerating wet coagulation of the dissolved binder. The water bath may be heated to further accelerate such coagulation. Further, instead of immersing the roll assembly in the water bath, the open axial end of the core shaft may be connected to a water supply device.

EXAMPLE 3

The porous roll assembly prepared in Example 1 is again used in this example.

For the purpose of this example, a bath 15 is prepared which contains DMF, 5% of polyurethane (available from SANYO CHEMICAL INDUSTRIES, LTD., Japan, under the product name "SANPRENE LQ-42"), and an anionic cell stabilizer (available from SANYO CHEMICAL INDUSTRIES, LTD., Japan, under the product name "SANMORIN OT-70") in an amount of 15% relative to the solid content of polyurethane. Further, a liquid supply roll 16 is rotatably arranged as partially dipped in the DMF solution bath 15, and the porous roll assembly is arranged above the liquid supply roll in rolling contact therewith.

In this example, the DMF solution is drawn up by the outer surface of the supply roll 16, and absorbed into the porous roll body 1. The absorbed DMF solution partially dissolves the polyurethane binder of the porous roll body only in an outer surface portion thereof, and retained there.

Figure 15:
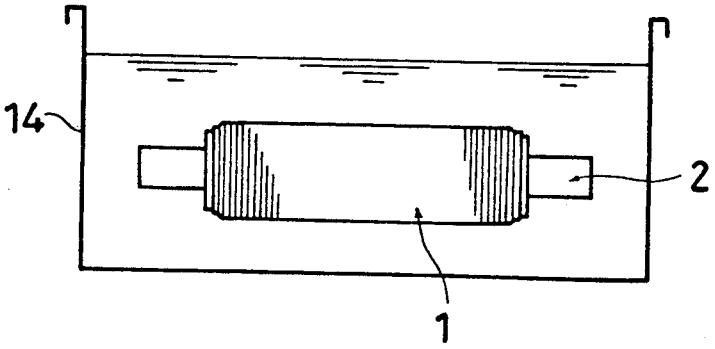
FIG. 15 is a schematic view showing a water bath for use in making the improved roll assembly.

Then, the porous roll assembly thus treated is immersed in the water bath 14, as shown in FIG. 15. As a result, the dissolved polyurethane (including a part originally continued in the DMF solution and another part coming from the roll body) is caused to coagulate as DMF diffuses into the water. At this time, the cell stabilizer previously contained in the DMF solution helps to form minute pores in the coagulated binder.

According to this embodiment, only the outer surface portion of the porous roll body 2 is reintegrated by the coagulated binder (polyurethane) because of the limited supply of the DMF solution. On the other hand, the used DMF solution originally contains a certain amount of polyurethane which is additionally used for wet coagulation together with the subsequently dissolved binder from the porous body. Thus, the binder content resulting from the wet coagulation can be rendered reasonably high.

If desired, the open axial end of the core shaft 2 may be connected to an unillustrated suction device during treatment with the DMF solution. In this case, the DMF solution can be made to diffuse into the porous roll body 1 to the full depth thereof.

The present invention being thus described, it is obvious that the same may be varied in many ways. For instance, the core shaft 2 may be solid instead of a hollow configuration, and its cross-sectional shape may be polygonal. Further, the axially extending grooves 6 on the outer cylindrical surface of the core shaft may be dispensed with if the inner diameter of each porous disk is suitably set relative to the outer diameter of the core shaft. Such variations are not to be regarded as a departure for the spirit and scope of the invention, and all such modifications as would be obvious to those skilled in the art are intended to be included within the scope of the following claims.

We claim:

1. A method of making a porous roll assembly which comprises a core shaft and a porous roll body fitted on said core shaft, said roll body comprising an overall stack of porous disks which are axially compressed, each disk having a central opening for fitting on said core shaft, the method comprising the steps of:

a) fixing a stopper to one end portion of said core shaft;

b) conducting a first compression step which includes fitting a first sub-stack of porous disks on said core shaft into abutment with said stopper, applying an axial compressive force to said first disk sub-stack, and relieving the compressive force;

c) conducting subsequent compression steps, each of which includes fitting a relevant sub-stack of porous disks on said core shaft into abutment with said first or a preceding disk sub-stack, applying an axial compressive force to said relevant sub-stack, and relieving the compressive force; and (d) conducting a last compression step which includes fitting a last sub-stack of porous disks on said core shaft into abutment with a preceding disk sub-stack, applying an axial compressive force to said last sub-stack, and fixing another stopper to the other end portion of said core shaft while the axial compressive is still applied;

wherein said core shaft has a cylindrical outer surface which is formed with axially extending grooves, each groove having an opening and a bottom not smaller in width than said opening, said each disk being formed, at said central opening thereof, with complementary projections for fitting in said grooves, the compression of said each disk causing material movement within each disk radially inwardly into said grooves.

2. The method as defined in claim 1, further comprising a preliminary step for determining the number of porous disks to be included in each sub-stack and the axial compressive force to be applied to the disk sub-stack prior to conducting said first compression step.

3. The method as defined in claim 1, wherein each porous disk is made of fibers and a binder, the method further comprising the steps of:

(e) preparing a solvent which selectively dissolves said binder;

(f) causing said solvent to diffuse into said porous roll body to dissolve said binder; and (g) removing said solvent from said porous body to allow the dissolved binder to re-coagulate in said porous body.

4. The method as defined in claim 3, wherein said solvent additionally contains a substance which is identical to said binder.

5. The method as defined in claim 3, wherein said solvent additionally contains a binder substance which has affinity with said binder of said each porous disk.

6. The method as defined in claim 3, wherein said solvent additionally contains a cell stabilizer.

7. The method of claim 1, wherein each groove is rectangular in cross section.

8. The method of claim 1, wherein each groove is trapezoidal in cross section.

9. The method of claim 1, wherein said core shaft is hollow and has a cylindrical wall which is formed with radical through-holes.

* * * * *